US008741393B2

(12) United States Patent
Brabbs et al.

(10) Patent No.: US 8,741,393 B2
(45) **Date of Patent: *Jun. 3, 2014**

(54) METHOD FOR PRODUCING METALIZED FIBROUS COMPOSITE SHEET WITH OLEFIN COATING

(75) Inventors: Noel Stephen Brabbs, Garnich (LU); Eric Huebsch, Contern (LU); Yuefei Tao, Hockessin, DE (US); Lech Wilczek, Wilmington, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 65 days.

This patent is subject to a terminal disclaimer.

(21) Appl. No.: 13/338,337

(22) Filed: Dec. 28, 2011

(65) Prior Publication Data

US 2013/0171460 A1 Jul. 4, 2013

(51) Int. Cl.
*B05D 3/06* (2006.01)
*B05D 3/10* (2006.01)

(52) U.S. Cl.
USPC ..... 427/553; 427/340

(58) Field of Classification Search
CPC ..... B05D 3/06; B05D 3/10; B32B 15/08
USPC ..... 427/532, 551, 558, 340
See application file for complete search history.

(56) References Cited

U.S. PATENT DOCUMENTS

| | | | |
|---|---|---|---|
| 3,081,519 | A | 3/1963 | Blades et al. |
| 3,169,899 | A | 2/1965 | Steuber |
| 3,227,784 | A | 1/1966 | Blades et al. |
| 3,851,023 | A | 11/1974 | Brethauer et al. |
| 4,173,682 | A | 11/1979 | Noomen et al. |
| 4,537,811 | A | 8/1985 | Nablo |
| 4,739,012 | A | 4/1988 | Hagman |
| 4,868,062 | A | 9/1989 | Hoeschele et al. |
| 4,999,222 | A | 3/1991 | Jones et al. |
| 5,128,391 | A | 7/1992 | Shustack |
| 5,221,560 | A | 6/1993 | Perkins et al. |

(Continued)

FOREIGN PATENT DOCUMENTS

| | | | |
|---|---|---|---|
| EP | 0431951 | B1 | 12/1991 |
| EP | 1400348 | A2 | 3/2004 |

(Continued)

OTHER PUBLICATIONS

Abstract POLY-448 presented at the 228th American Chemical Society National Meeting, Philadelphia, PA 2004.

(Continued)

*Primary Examiner* — Dah-Wei D Yuan
*Assistant Examiner* — Nga Leung V Law

(57) ABSTRACT

A composite sheet is manufactured by depositing a multilayer coating on the outer surface of a substrate, the coating comprising a metal layer and an outer polymeric layer formed from a precursor comprising a composition capable of being polymerized and/or cross-linked by free-radical processes. After the precursor is applied, the composite sheet is exposed to beam radiation and ozone, which both promote conversion of the precursor. The function of the cured polymeric layer includes protecting the metal layer from corrosion. The use of both beam radiation and ozone promotes substantially full conversion and curing of the precursor, even in portions of the substrate that are geometrically shadowed from incident beam radiation.

15 Claims, 6 Drawing Sheets

(56) References Cited

U.S. PATENT DOCUMENTS

| | | | |
|---|---|---|---|
| 5,371,116 | A | 12/1994 | Sakamoto et al. |
| 5,374,483 | A | 12/1994 | Wright |
| 5,955,175 | A | 9/1999 | Culler |
| 6,080,816 | A | 6/2000 | Gregorovich et al. |
| 6,083,628 | A | 7/2000 | Yializis |
| 6,146,724 | A | 11/2000 | Roth |
| 6,204,350 | B1 | 3/2001 | Liu et al. |
| 6,231,939 | B1 | 5/2001 | Shaw et al. |
| 6,268,456 | B1 | 7/2001 | Gregorovich et al. |
| 6,323,253 | B1 | 11/2001 | Bennington |
| 6,329,489 | B1 | 12/2001 | Gregorovich et al. |
| 6,562,222 | B1 | 5/2003 | Sekiguchi et al. |
| 6,706,412 | B2 | 3/2004 | Yializis |
| 6,955,728 | B1 | 10/2005 | van Ooij et al. |
| 7,491,433 | B2 | 2/2009 | Bletsos et al. |
| 7,951,867 | B2 | 5/2011 | Issari |
| 2004/0028931 | A1 | 2/2004 | Bletsos et al. |
| 2004/0149959 | A1 | 8/2004 | Mikhael et al. |
| 2004/0213918 | A1 | 10/2004 | Mikhael et al. |
| 2004/0241454 | A1 | 12/2004 | Shaw et al. |
| 2005/0178330 | A1 | 8/2005 | Goodwin et al. |
| 2005/0214553 | A1 | 9/2005 | Yannetti et al. |
| 2005/0260420 | A1 | 11/2005 | Collins et al. |
| 2006/0040091 | A1 | 2/2006 | Bletsos et al. |
| 2006/0078700 | A1 | 4/2006 | Bletsos et al. |
| 2006/0117988 | A1 | 6/2006 | Mikhael et al. |
| 2006/0226399 | A1 | 10/2006 | Mikhael et al. |
| 2007/0037465 | A1 | 2/2007 | Nutz et al. |
| 2007/0048512 | A1 | 3/2007 | Mikhael et al. |
| 2007/0166528 | A1 | 7/2007 | Barnes et al. |
| 2007/0166556 | A1 | 7/2007 | Yializis et al. |
| 2007/0196610 | A1 | 8/2007 | O'Rourke et al. |
| 2008/0057292 | A1 | 3/2008 | Bletsos |
| 2008/0060302 | A1 | 3/2008 | Bletsos et al. |
| 2008/0187740 | A1* | 8/2008 | Bletsos et al. ..... 428/306.6 |
| 2009/0041936 | A1 | 2/2009 | Yializis et al. |
| 2009/0079216 | A1 | 3/2009 | Kuroda |
| 2009/0825144 | | 3/2009 | Dean et al. |
| 2009/0124951 | A1 | 5/2009 | Bletsos |
| 2009/0202739 | A1 | 8/2009 | O'Neill et al. |
| 2009/0223035 | A1 | 9/2009 | Tanaka et al. |
| 2010/0136865 | A1 | 6/2010 | Bletsos |
| 2010/0143676 | A1 | 6/2010 | Hahn et al. |
| 2010/0160471 | A1 | 6/2010 | Sengupta et al. |
| 2010/0247855 | A1 | 9/2010 | Bletsos |
| 2011/0098402 | A1 | 4/2011 | Yamane et al. |

FOREIGN PATENT DOCUMENTS

| | | | | |
|---|---|---|---|---|
| JP | 06011706 | A | * | 1/1994 |
| WO | 9812494 | A1 | | 3/1998 |
| WO | 9818852 | A1 | | 5/1998 |
| WO | 0004055 | A1 | | 1/2000 |
| WO | 0140359 | A1 | | 6/2001 |
| WO | 0159809 | A1 | | 8/2001 |
| WO | 0228548 | A2 | | 4/2002 |
| WO | 03084682 | A1 | | 10/2003 |
| WO | 2005014874 | A1 | | 2/2005 |
| WO | 2005110626 | A2 | | 11/2005 |

OTHER PUBLICATIONS

ISO 811-1981, Textile Fabrics—Determination of Resistance to Water Penetration—Hydrostatic Pressure Test, Oct. 1, 1981.

ASTM Standard C1371-04A, Test Method for Determination of Emittance of Materials Near Room Temperature Using Portable Emissometers, 2010.

ASTM Standard D737-04, Test Method for Air Permeability of Textile Fabrics, 2008.

ASTM Standard F1249-06, Standard Test Method for Water Vapor Transmission Rate Through Plastic Film and Sheeting Using a Modulated Infrared Sensor, 2011.

Studer et al., Redox and photoinitiated crosslinking polymerization I. Dual cure isocyanate acrylate system, Progress in Organic Coatings, 2005, 53, 126-133, Elsevier.

Studer et al., Redox and photoinitiated crosslinking polymerization II. Neat acrylate resin, Progress in Organic Coatings, 2005, 53, 134-146, Elsevier.

Studer et al., Redox and photoinitiated crosslinking polymerization III. Clear and pigmented acrylic coatings, Progress in Organic Coatings, 2005, 53, 230-239, Elsevier.

U.S. Appl. No. 13/293,184, filed Nov. 10, 2011.

Office Action in U.S. Appl. No. 13/293,184, Jul. 3, 2013.

U.S. Appl. No. 13/338,344, filed Dec. 28, 2011.

U.S. Appl. No. 13/293,203, filed Nov. 10, 2011.

International Search Report & Written Opinion, PCT/US2012/064321, Mar. 20, 2013.

International Search Report & Written Opinion, PCT/US2012/064547, Mar. 28, 2013.

Office Action, U.S. Appl. No. 13/293,184, Dec. 16, 2013.

Office Action, U.S. Appl. No. 13/338,344, Dec. 30, 2013.

Office Action, U.S. Appl. No. 13/293,203, Dec. 13, 2013.

* cited by examiner

METHOD FOR PRODUCING METALIZED FIBROUS COMPOSITE SHEET WITH OLEFIN COATING

CROSS-REFERENCE TO RELATED APPLICATIONS

The subject matter of the present application is related to that of U.S. patent application Ser. No. 13/293,184, filed Nov. 10, 2011, and entitled "Metalized Fibrous Composite Sheet With Olefin Coating" and to that of U.S. patent application Ser. No. 13/293,203, filed Nov. 10, 2011, and entitled "Method For Producing Metalized Fibrous Composite Sheet With Olefin Coating." Both these applications are incorporated herein in their entirety for all purposes by reference thereto.

TECHNICAL FIELD

This invention relates to a method for effecting polymerization of an olefin and, more particularly, to a method for producing a metalized, fibrous composite sheet with an olefin coating that employs a combination of radiation from an e-beam or UV source with exposure to ozone to effect olefin polymerization and cross-linking of the polyolefin coating.

BACKGROUND OF THE INVENTION

The polymerization of many common monomers and polymer cross-linking can be induced by exposure to radiation in the form of either photons or electrically charged particles. Energy deposited in the monomer by either radiation is believed to cause formation of free radicals, which in turn can induce polymerization and cross-linking. The term "beam radiation" is used herein to refer collectively to any form of charged particle-beam or photon irradiation that is capable of initiating or otherwise promoting polymerization of a monomer or cross-linking of any other polymer precursor.

Beam radiation is widely used in industrial practice to promote polymerization, cross-linking, and/or curing (herein referred to collectively as "conversion") of monomers or other polymeric coating precursors. Beam radiation typically is derived from a radiation source, and readily lends itself to in-line, continuous processes, such as those appointed for producing indefinite lengths of thin sheet material that include a polymeric coating. For example, the production of such material may include steps of applying the coating precursor to an advancing web and then exposing the coated web to a suitable radiation source. Ideally, the energy of the particles or photons must be sufficient both to penetrate the desired coating thickness and deposit enough energy to generate free radicals. Typically, energetic electrons (often termed "e-beam radiation") or photons in the ultraviolet (UV) range are employed. A relatively short-duration exposure to radiation of suitable intensity generally suffices, without unduly increasing the substrate temperature. Sources capable of producing any of the foregoing forms of radiation are known in the art.

However, beam radiation by its very nature is effective only for initiating curing of precursor material that lies in a line of sight. That is to say, beams of either charged particles or photons typically emanate from the radiation source and propagate therefrom along a straight-line path. Curing can be induced only for material positioned so as to intercept the direct beam. Although e-beams can in principle be deflected by electrostatic or magnetic forces, in practice the extent of deflection attainable with practical electromagnetic structures is relatively limited. UV light can be directed to some extent by optical structures such as lenses, mirrors, and gratings analogous to those used with visible light. However, UV optics typically are more difficult to construct and maintain than their visible-spectrum counterparts.

Thus, the use of these forms of beam radiation to polymerize and cure polymer precursors that coat simple, planar substrate structures is straightforward. However, beam-induced curing of precursors used to coat structures that depart from strict planarity is less satisfactory because of the problem of shadowing. More specifically, areas of the substrate that do not lie in the line of sight of the beam source inherently do not receive any radiation, and so may be said to be shadowed. Even if the beam has relatively high divergence and may emanate from a source that is other than a point source (such as a line or other extended source) or that is otherwise diffused, the fundamental limitation of line of sight remains. Thus, the polymerization and cross-linking reactions in shadowed areas cannot be initiated by the beam radiation.

Failure to cure even a small fraction of the precursor in a coating can, in some cases, be highly objectionable. Many uncured monomers commonly used in coatings, notably acrylates, are known to be toxic, to emit objectionable odors, and to impart undesirable tackiness and dust pickup to a surface, even in relatively small amounts. The presence of tacky monomer on a sheet surface makes it difficult to unroll material from a supply roll. Thus, techniques that result in substantially complete curing of a coating to mitigate these detrimental consequences remain highly sought.

The problem of shadowing arises in principle for beam-based curing of the coating of any non-planar article. An approach to the problem of shadowing in curing acrylate coatings has been proposed by Studer et al., Progress in Organic Coatings (2005), 53(2), 126-133; Progress in Organic Coatings (2005), 53(2), 134-146; and Progress in Organic Coatings (2005), 54(3), 230-239. These disclosures suggest the combination of photoinitiated polymerization and crosslinking with a thermally-initiated radical polymerization, which is made possible by the inclusion of both a photoinitiator, such as an acylphosphine oxide, and a suitable redox thermal initiator, such as cerium(IV) ammonium nitrate $[Ce(NH_4)_2(NO_3)_6]$, in the coating precursor material. Such a dual-cure process is said to be viable for automobile pigmented paint and clearcoat applications. For coatings on items such as an automobile body or portion thereof, the shape inherently causes UV illumination to be at least non-uniform, if not completely shadowed, in portions of the object. However, the dual-cure processes suggested by the Studer references require that the substrate be heated. In some of the examples given, a temperature of about 140° C. is specified. Many polymer substrates cannot withstand such a temperature. Although some curing would occur at lower temperatures, the kinetics of the cross-linking reaction would then dictate impractically long hold times. Thus, a process involving thermal curing is not even a feasible option for many substrate materials.

The shadowing problem is especially vexing in connection with the coating of generally planar but fibrous materials, in which substantial portions of the effective surface are shadowed by the inherent topology of the surface. Application of the coating precursor material, especially if done by vapor-phase methods, inevitably causes some of the precursor material to be deposited in interstices created by the network of fibers defining the surface layer. These interstices are below the bulk surface of the substrate, but are still in its immediate vicinity. They are readily able to communicate with the surrounding atmosphere. Directing beam radiation to impinge on the fibrous sheet material at varying angles of incidence only partially mitigates shadowing, because the inherent topology of the surface texture dictates that the underside of some fibers has no outward-facing exposure.

Planar, fibrous sheet materials used in the building construction industry as moisture vapor-permeable sheets for wall and roof wrapping provide an example in which the problem of shadowing can arise, as some forms of these materials include a surface polymeric coating that must be cured by cross-linking.

US Published Patent Application No. US2008/0187740 to Bletsos et al. ("the '740 publication"), which is commonly owned with the present application, discloses a metalized, moisture vapor permeable composite sheet formed by coating at least one side of a moisture vapor permeable substrate with at least one metal layer and at least one thin polymeric coating layer on the side of the metal layer opposite the substrate. The coating may be formed under vacuum using vapor deposition techniques under conditions that substantially coat the substrate without significantly reducing its moisture vapor permeability. The composite sheet is said to have high moisture vapor permeability, and good thermal barrier properties. The composite sheet can also be selected to provide a high barrier to intrusion by liquid water (signaled by a high hydrostatic head), which is another important characteristic for construction end uses such as house wrap and roof lining. Such a composite sheet is said to provide a thin, strong, breathable air and thermal barrier that is suitable for use in existing or new construction.

Notwithstanding these advances, there remains a need for improved products in which coated fibrous materials can be produced efficiently yet retain their desirable physical and structural properties throughout their entire lifecycle.

SUMMARY OF THE INVENTION

In an aspect, the present invention provides a process for manufacturing a composite sheet that comprises:

providing a substrate having a first outer surface and an opposing second outer surface;

metalizing the first outer surface of the substrate to form thereon a metal layer;

depositing on the metal layer a precursor of an outer polymeric coating layer to form a precursor film, the precursor comprising a composition capable of being converted by free-radical processes; and treating the precursor to form the outer polymeric coating layer, the treating comprising:

creating free radicals in the precursor to induce conversion of at least a portion thereof, the creating comprising exposure of the precursor film to ozone.

Optionally, the curing is accomplished by a process comprising depositing of the precursor on the metal layer and exposing it to ozone.

Another aspect provides a composite sheet comprising:

a substrate having a first outer surface and an opposing second outer surface; and a multi-layer coating on the first outer surface of the substrate, the multi-layer coating comprising:

a metal layer overlaying the first outer surface of the substrate; and an outer polymeric coating layer overlaying the metal layer and formed by curing a precursor that comprises a composition capable of being converted by free-radical processes.

Still other aspects provide a wall system or a roof system comprising the foregoing composite sheet.

BRIEF DESCRIPTION OF THE DRAWINGS

The invention will be more fully understood, and further advantages will become apparent, when reference is made to the following detailed description of the preferred embodiments of the invention and the accompanying drawings in which.

DETAILED DESCRIPTION

Figure 1:
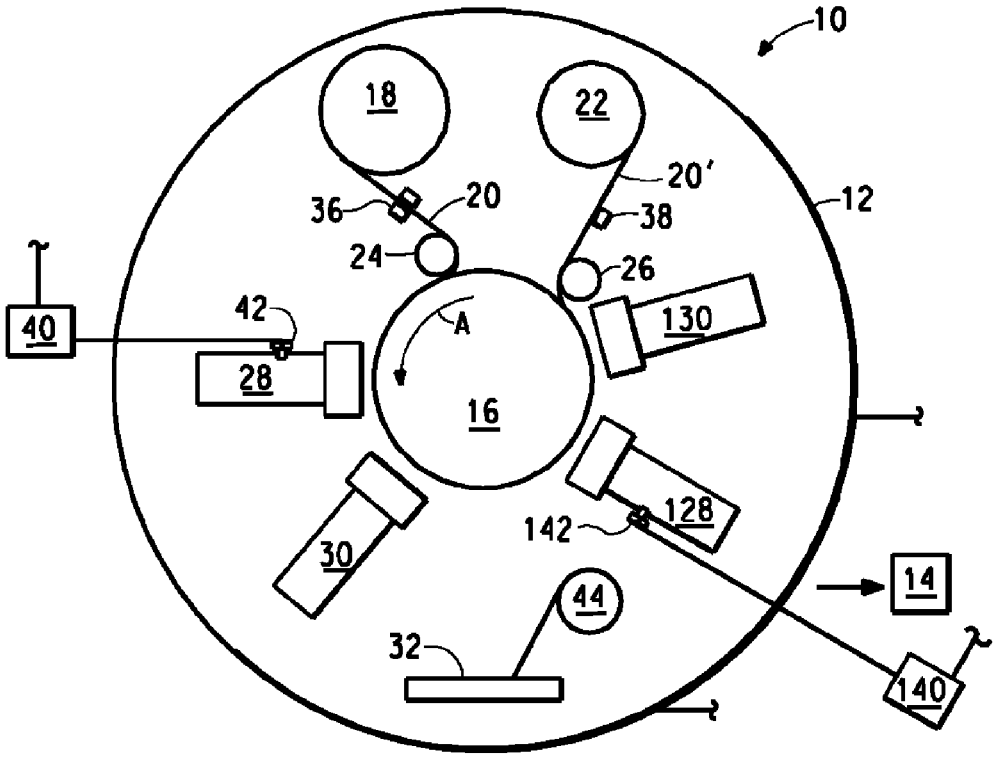
FIG. 1 (Prior Art)
FIG. 1 is a schematic diagram of a prior-art apparatus for coating a substrate material.

The term "nonwoven sheet" as used herein refers to a structure of individual strands (e.g. fibers, filaments, or threads) that are positioned in a random manner to form a planar material without an identifiable pattern, as opposed to a knitted or woven fabric. Exemplary forms of nonwoven sheet include materials commonly termed nonwoven fabrics, nonwoven webs, and nonwoven layers. The term "fiber" is used herein to include staple fibers as well as continuous filaments. Examples of nonwoven sheets include meltblown webs, spunbond nonwoven webs, flash spun webs, staple-based webs including carded and air-laid webs, spunlaced webs, and composite sheets comprising more than one nonwoven web.

The term "woven sheet" is used herein to refer to sheet structures formed by weaving a pattern of intersecting warp and weft strands.

The term "fabric" is used herein to refer to both woven and nonwoven articles comprising a network of interlinked fibers, filaments, or threads forming a thin, generally planar and flexible structure.

The term "spunbond fibers" is used herein to refer to fibers that are melt-spun by extruding molten thermoplastic polymer material as fibers from a plurality of fine, usually circular, capillaries of a spinneret with the diameter of the extruded fibers then being rapidly reduced by drawing and then quenching the fibers.

The term "meltblown fibers" is used herein to refer to fibers that are melt-spun by meltblowing, which comprises extruding a melt-processable polymer through a plurality of capillaries as molten streams into a high velocity gas (e.g. air) stream.

The term "spunbond-meltblown-spunbond nonwoven sheet" ("SMS") is used herein to refer to a multi-layer composite sheet comprising a web of meltblown fibers sandwiched between and bonded to two spunbond layers. Additional spunbond and/or meltblown layers can be incorporated in the composite sheet, for example spunbond-meltblown-meltblown-spunbond webs ("SMMS"), etc.

The term "plexifilamentary" is used herein to characterize a three-dimensional integral network or web of a multitude of thin, ribbon-like, film-fibril elements of random length and with a mean film thickness of less than about 4 μm and a median fibril width of less than about 25 μm. In plexifilamentary structures, the film-fibril elements are generally coextensively aligned with the longitudinal axis of the structure and they intermittently unite and separate at irregular intervals in various places throughout the length, width, and thickness of the structure to form a continuous three-dimensional network. A nonwoven web of plexifilamentary film-fibril elements is referred to herein as a "flash spun plexifilamentary sheet".

As used herein, the term "tape" refers to a flattened strand, such as flattened strands formed from a slit film.

As used herein, the term "metal" includes metal alloys as well as individual metals.

The term "wall system" is used herein to refer a wall in a building construction. A wall system ordinarily includes internal lining and outer skin layers, and other wall elements intermediate the internal lining and outer skin layers. The intermediate elements can include supporting frame elements such as vertical wooden or metal studs, at least one air space, insulation material, one or more optional vapor barrier layers, and a moisture vapor permeable sheet such as the composite sheet provided herein.

The term "roof system" is used herein to refer to a roof in a building construction. A roof system ordinarily includes supporting roof frame elements such as pitched wooden rafters, external roofing material and other roof elements. Roof systems can be classified as warm roof systems and cold roof systems. In a cold roof system, the other roof elements can include at least one optional vapor barrier layer, at least one air space (which can be the attic air space), elements intermediate the supporting roof frame elements and the external roofing material such as battens or solid sheathing, a moisture vapor permeable sheet, such as the present composite sheet, and insulation material installed at the floor level of the attic space, above the interior ceiling level. In a warm roof system, the other roof elements can include, in addition to those listed for a cold roof system, an attic ceiling and insulation installed above the attic ceiling (instead of at the floor level of the attic space). The other roof elements can be intermediate the supporting roof frame elements and the external roofing material, or attached to the side of the supporting roof frame elements facing towards the attic space, or installed between adjacent roof frame elements, etc., depending on the specific roof element.

An aspect of the present invention provides a metalized composite sheet, in which a substrate is overlaid with a metal layer and an outer protective polymer coating layer. In an embodiment, the metallization and polymer layers are applied to a surface of a moisture-permeable substrate in a manner that substantially preserves the substrate's permeability. The substrate may be a sheet layer in which one or both sides comprise a porous outer surface, such as a fibrous surface or a porous film. In an embodiment, the polymeric and metal layers are formed using physical vapor-phase deposition techniques, such as evaporation. Typically the polymeric material is derived from a monomeric precursor that is first deposited as a vapor and subsequently polymerized and cured to form the final material. These techniques deposit precursor material on the exposed, outward-facing surfaces of the substrate, but in addition, some amount of the material ordinarily permeates within the surface structure and is deposited through the external surface and onto internal surfaces that define interstices or pores, e.g. as formed by an interlinking network of fibers.

In an embodiment, the deposition processes and material are controlled such that the pores and interstices are not significantly bridged, covered, or filled, so that the composite structure retains a desired level of moisture vapor permeability. For example, at least 80% of the permeability of the uncoated substrate may be preserved after the full coating is formed and fully processed. In some embodiments, at least 90%, or 95%, or 98% of the uncoated permeability is retained. The coating material delivered may also be controlled such that the surfaces of fibers in the interior structure of the substrate remain substantially uncoated. For some end-use applications, high moisture permeability may not be required, so that some implementations need not feature retention of a high permeability after coating and thicker coatings may thus be permitted.

In other implementations the polymer precursor is applied by any method that permits application of a sufficiently uniform coating having the requisite thickness. Without limitation, such methods may employ brushes, pads, rollers, spray or mist coating, dipping, or flow, roll, or curtain coating, or the like. Certain printing processes, including without limitation flexographic printing, may also be used. In some of these implementations, the vapor permeability of the substrate is substantially maintained after such deposition.

The present metalized sheet is beneficially employed in applications that include wall and roof systems. In embodiments useful in these situations, the sheet's moisture permeability permits the escape of water vapor that would otherwise be trapped in wall or roof cavities. Such water vapor can originate in numerous ways, including normal domestic activities such as bathing, showering, and cooking, or from building occupants as evaporated sweat or exhalation as the product of metabolism. Water vapor that condenses in building cavities, especially during cold seasons, can cause rotting or other damage to structural members. On the other hand, the permeability of the present sheet ordinarily is not high enough to permit significant air or water infiltration.

Front-surface metallization beneficially imparts insulation value to the basic sheet material. Incorporating a metalized material in wall or roof surfaces improves the energy efficiency of a building, e.g. by causing reflection of incoming solar radiation during warm summer and reducing the amount of heat radiated from the structure during cold winter. The effectiveness of the metallization layer for both these functions may be quantified by its emissivity, which is the ratio of the power per unit area radiated by a surface to that radiated by a perfect black body at the same temperature. A black body therefore has an emissivity of one and a perfect reflector has an emissivity of zero. The lower the emissivity, the better the thermal barrier properties pertinent for both seasons, i.e. improved reflection of incident radiation in summer and reduced emission of thermal radiation in winter. However, it has been found that the effectiveness of the metalization layer in some existing products is subject to degradation, as reflected in an increased emissivity believed to be caused by corrosion of the metal surface.

As noted above, the '740 publication provides a process for manufacturing a plexifilamentary sheet on which organic and metal layers are coated under vacuum. This process can be implemented using the apparatus schematically shown at 10 in FIG. 1 of the present application, which is a reproduction of FIG. 1 of the '740 publication.

Apparatus 10 includes a vacuum chamber 12, which is connected to a vacuum pump 14, permitting evacuation of the chamber to a desired pressure. Moisture vapor permeable, plexifilamentary sheet 20 is supplied from unwind roll 18 onto a cooled rotating drum 16, which rotates in the direction shown by arrow "A", via guide roll 24. The sheet forms a substrate that passes through several deposition stations, after which it is picked off of the surface of the rotating drum by guide roller 26 and taken up by wind-up roll 22 as a coated composite sheet. Drum 16 may be cooled to a temperature said to be chosen to facilitate condensation of the particular precursor appointed to form the organic coating. Vacuum compatible monomers, oligomers, low molecular weight polymers, and combinations thereof are said by the '740 publication to be suitable for preparing organic coating layers. After unwinding from roll 18, the substrate passes through optional plasma treatment unit 36, where the surface of the sheet is exposed to a plasma discharge excited by low frequency RF, high frequency RF, DC, or AC.

According to the '740 disclosure, an intermediate organic layer may be formed on the substrate prior to depositing the metal layer, e.g. by deposition of organic precursor on the substrate from evaporator 28, which is supplied with liquid precursor from a reservoir 40 through an ultrasonic atomizer 42. It is said that with the aid of heaters, the liquid is instantly vaporized, i.e., flash vaporized, so as to minimize the opportunity for thermal polymerization or degradation prior to being deposited on the substrate.

The vaporized precursor condenses on the surface of the substrate sheet and forms a liquid film layer that is said to be solidified rapidly after condensation onto the sheet using a radiation curing means 30. Suitable radiation curing means are said to include electron beam and ultraviolet radiation sources that cure the monomer or other precursor film layer by causing polymerization or cross-linking of the condensed layer. If an electron beam gun is used, the energy of the electrons should be sufficient to polymerize the coating in its entire thickness. For oligomers or low molecular weight polymers that are solid at room temperature, it is said that curing may not be required. Monomers said by the '740 publication to be useful include acrylates disclosed by U.S. Pat. No. 6,083,628 and international patent publication WO98/18852.

After depositing the intermediate organic layer, the coated substrate in the '740 process then passes to metallization system 32, where the metal layer is deposited on the organic layer. When a resistive metal evaporation system is used, the metallization system is continually provided with a source of metal from wire feed 44.

Following the metallization step, an outer organic coating layer is deposited in a similar process as described above for the intermediate polymer layer using evaporator 128, precursor reservoir 140, ultrasonic atomizer 142, and radiation curing means 130.

The thickness of the coating is said to be controlled by the line speed and vapor flux of the flash evaporator. As the coating thickness increases, the energy of the electron beam must be adjusted in order for the electrons to penetrate through the coating and achieve effective polymerization.

However, the present inventors have found that practical application of the foregoing process provided by the '740 publication is limited by its ability to efficiently produce a composite coated sheet product that attains all the desired functional properties. Ideally, the product retains substantially all of its porosity after the coating process, with its metalized layer remaining highly reflective, and thus insulative, for an indefinite period. In addition, it is desired that little or none of the organic coating be left un-polymerized.

In particular, the sheet provided by the '740 publication exemplifies the difficulty of using beam radiation to effect curing of a polymeric layer deposited on a fibrous substrate, because of the problem of shadowing inherently resulting from the three-dimensional topography of such a substrate.

It is known that an inadequately protected surface layer of aluminum, a metal commonly used for metallization, may undergo a continuing reaction with ambient moisture to form oxides or hydroxides beyond the native oxide that may form virtually immediately. Such a reaction typically results in undesirably degraded reflectivity and increased emissivity. A thicker polymeric layer would better protect the aluminum, but would exacerbate both the problem of incomplete curing and the likelihood for reduced permeability of the coated sheet, as more of the pores in the open network would tend to become filled. Techniques that might mitigate the reduction in porosity have been found to be prone to degrading the uniformity of coating, so that the expected protective benefit for the metal layer would not be fully realized in practice. In some instances, it has been found that a conventional coating must be applied and cured in multiple layers to provide an ultimate thickness affording adequate protection for the metallization, while attaining even a minimally tolerable curing fraction.

Figure 2A:
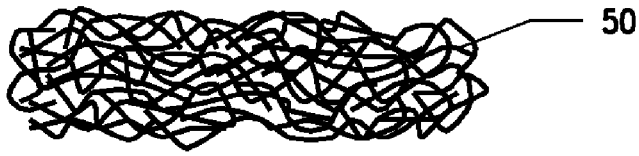
FIG. 2A (Prior Art)
FIGS. 2A-2D are schematic, cross-sectional views of a prior art plexifilamentary substrate material at successive stages in which a multi-layer coating is being formed.
Figure 2B:
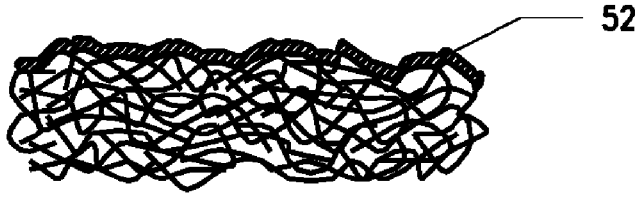
FIG. 2B (Prior Art)

The difficulties encountered with a prior-art production method such as that of FIG. 1, may be visualized by reference to FIGS. 2A-2D, which schematically depict a product in various stages of its production using such a method. A plexifilamentary substrate, such as a conventional TYVEK® sheet 50 (FIG. 2A), is metalized in vacuum by overlaying a thin Al layer 52 provided by evaporation from a bulk Al source (FIG. 2B). Then a suitable precursor, such as an acrylate monomer, is evaporated and deposited onto the Al-metalized sheet as a coating 54, which may be about 0.5 to 1 μm thick.

Figure 2C:
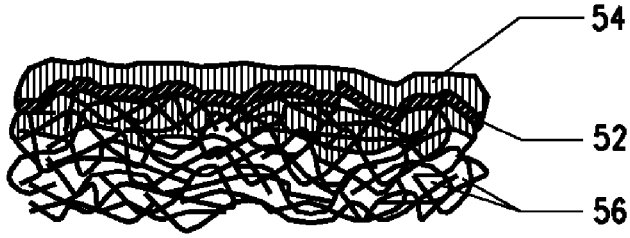
FIG. 2C (Prior Art)

As schematically indicated in FIG. 2C, the open, three-dimensional porous structure characteristic of the plexifilamentary nature of TYVEK® sheet includes interstices 56, into which some of the deposited precursor inevitably infiltrates.

Figure 2D:
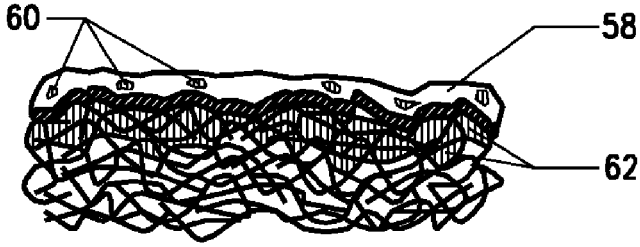
FIG. 2D (Prior Art)

The deposited precursor is then cured to provide the required protective surface coating for the aluminized layer of the TYVEK® sheet. In some implementations, e-beam curing is used, meaning that the polymer precursor is exposed to the radiation of an e-beam that initiates monomer polymerization and polymer cross-linking of the coating to form the exterior protective polymeric coating (surface layer) 58 (FIG. 2D). By controlling the process parameters for both the Al and precursor depositions, the porosity of the bare TYVEK® sheet 50 generally can be maintained, meaning that the porosity of the sheet after the depositions is typically at least about 80% of the porosity of the starting sheet. By way of contrast, some previous coatings, such as a polyurethane coating deposited as a liquid by a flexographic printing process, have reduced permeability by 50% or more.

However, it has been found that the foregoing process typically results in an incomplete curing of acrylate monomers or other like precursors conventionally used in forming the protective polymeric coating 58. While the fraction of the coating 58 that is cured by present methods may be substantial, and may even comprise a preponderance of the deposited precursor, it is found in practice that some appreciable portion remains uncured. As apparent in FIG. 2D, the uncured portion may comprise both regions 60 within the surface 58, but, more importantly, regions 62 within interstices 56 that are geometrically shadowed from the incident e-beam. The presence of even modest amounts of unconverted acrylate monomer is undesirable.

The impediments of the foregoing process are addressed by the improved curing processes provided in accordance with the present invention. As used herein, the term "precursor" is understood to refer to a substance suitable for preparing the polymeric coating layer of the present composite sheet material. Such substances include monomers, oligomers or low molecular weight (MW) polymers, and combinations thereof. The precursor may comprise one or more chemical components. In an embodiment, the precursor material is vacuum compatible but has high enough vapor pressure to evaporate rapidly in an evaporator without undergoing thermal degradation or polymerization, and at the same time does not have a vapor pressure so high as to overwhelm the vacuum system. The ease of evaporation depends on factors that include the molecular weight and the intermolecular forces between the monomers, oligomers or polymers, along with the ambient pressure in the coating chamber. It has been found that vacuum compatible monomers, oligomers and low MW polymers useful in this invention typically can have weight average molecular weights up to approximately 1200.

In an embodiment, the foregoing curing process is enhanced by combining an exposure of the deposited precursor to beam radiation with an exposure to a source of ozone. It has been found that precursors in which curing and cross-linking can be effected by beam radiation also respond to ozone. The amenability of the precursor to ozone promotes conversion even in shadowed regions of a fibrous or irregularly shaped substrate that are difficult or impossible to expose to beam radiation.

In some embodiments, the precursor further includes a photoinitiator, which is particularly beneficial if UV radiation is to be used to induce curing. One such photoinitiator is 2-hydroxy-2-methyl-1-phenyl-1-propanone, which is sold commercially as DAROCUR 1173 by Ciba Specialty Chemicals Inc., Basel, Switzerland, but others known in the art may also be used.

The exposures to beam radiation and ozone can be accomplished either simultaneously or separately. In an embodiment, the beam radiation is sufficient to cause curing of a major fraction of the precursor, while a subsequent ozone exposure promotes conversion of at least a substantial portion of the residual uncured precursor, especially the fraction located within parts of the fiber interstices shadowed from the beam radiation.

Materials suitably employed in the present precursor include, without limitation, various comonomers such as acrylates or methacrylates that are radically curable. They may include, but are not limited to, polyol acrylates, acidic acrylates, amino acrylates and ether acrylates, as well as acrylates with other functionalites including hydroxyl, amine, amide, carboxylic, olefin, epoxy, phosphate, or sulfonic acid functionalities, and other radically polymerizable monomers including without limitation 1,3-dienes, styrene, substituted vinylbenzenes, halogenated olefins, vinyl esters, acrylonitrile, methacrylonitrile, N-vinyl carbazole, N-vinyl pyrrolidone. Also useful in some embodiments are aliphatic, alicyclic, and aromatic oligomers or polymers or fluorinated acrylate oligomers or polymers. The precursor may comprise any one or more of these constituents. Suitable precursor constituents include materials disclosed by published patent applications US 2004/0241454 to Shaw et al., US2006/0078700 to Bletsos et al., and US 2006/0040091 to Bletsos et al., all of which are hereby incorporated in their entirety by reference thereto.

Embodiments, particularly those in which the precursor is applied using flash evaporation, may include an appreciable amount of diacrylate and/or triacrylate to promote crosslinking. Blends of suitable acrylates or methacrylates may be employed for obtaining desired evaporation and condensation characteristics and adhesion, and for control of shrinkage of the deposited film during polymerization. Ideally, molecules used in flash evaporation processes have sufficient thermal stability so they can be evaporated without decomposing and without polymerizing before they are deposited on the substrate, but thereafter can readily be cross-linked upon exposure to beam radiation. Triacrylates tend to be reactive and may polymerize at the evaporation temperatures. Increasing a precursor's average molecular weight generally necessitates a higher evaporation temperature but facilitates condensation on an unchilled substrate.

In addition, it is generally found that the shrinkage upon curing is reduced by using materials with higher molecular weight per reactive group. Embodiments using a multi-component precursor are beneficially formulated such that the constituents have compatible evaporation and condensation characteristics to ensure that the precursor can be deposited and condensed without appreciable fractionation.

In an embodiment, the average molecular weight (MW) of monomers used in the precursor may be in the range of from 200 to 1200 for materials that are to be vacuum vapor deposited. It is found that using such a range balances the desirable characteristics of precursor evaporation at a reasonable temperature, precursor condensation on an unchilled substrate, and acceptably shrinkage that does not cause undue deformation of the substrate. However, the precursor used for the present composite sheet may include constituents having any molecular weight compatible with the deposition of a uniform coating of the desired composition. Because of their somewhat lower reactivity, some fluorinated monomers with higher molecular weights can also be used, as their volatilities are equivalent to those of lower molecular weight non-fluorinated acrylates.

In various embodiments, any of a wide variety of monoacrylates, diacrylates, triacrylates, and tetraacrylates may be included in the composition. Generally it is desirable for improving monomer conversion and cross-linking that at least a major portion of the acrylate monomer used in the present precursor is a polyfunctional acrylate. In an embodiment, the acrylate comprises at least 70 percent polyfunctional acrylates such as diacrylate or triacrylate.

In one embodiment, the precursor comprises hexane diol diacrylate (HDDA, MW of about 226) and/or tripropylene glycol diacrylate (TRPGDA, MW of about 300). Other acrylates may be used, sometimes in combination, such as: monoacrylates lauryl acrylate (MW 240) or epoxy acrylate RDX80095 made by Radcure of Atlanta, Ga.; diacrylates diethylene glycol diacrylate (MW 214), neopentyl glycol diacrylate (MW 212), propoxylated neopentyl glycol diacrylate (MW 328), polyethylene glycol diacrylate, tetraethylene glycol diacrylate (MW 302), and bisphenol A epoxy diacrylate; and triacrylates trimethylol propane triacrylate (MW 296), ethoxylated trimethylol propane triacrylate (MW 428), propoxylated trimethylol propane triacrylate (MW 470) and pentaerythritol triacrylate (MW 298). Monomethacrylates and dimethacrylates such as triethylene glycol dimethacrylate (MW 286) and 1,6-hexanediol dimethacrylate (MW 254) may also be useful, but may cure too slowly to be useful for some high speed coating operations.

It is found that film forming properties and adhesion between an acrylate coating and a substrate sheet may be enhanced by using a precursor that contains some amount of high molecular weight components. In practice very high molecular weight oligomers are usually mixed with low molecular weight monomers. The oligomers usually have molecular weights of greater than 1000, and often as large as 10,000 or even higher. Monomers are used as diluents to lower the coating viscosity and provide an increased number of linking groups for enhancing cure speed, hardness and solvent resistance in the resulting coating. It has generally been found infeasible to apply these high molecular weight substances directly by evaporation. However, by mixing high and low molecular weight constituents, satisfactory and efficient flash evaporation, condensation, and curing can be obtained.

When blends of high and low molecular weight acrylates are used, it is preferred that the weighted average molecular weight of the blend be in the range of from 200 to 1200. Such a precursor has been found to provide a desirable balance among the atomization and vaporization, condensation, and shrinkage characteristics.

In certain embodiments, the precursor is formulated to have a vapor pressure at 25° C. that ranges from about 0.1 to 100 Pa. Too low a vapor pressure requires an unacceptably high operating temperature to be able to evaporate sufficient material to form a coating on the sheet substrate at reasonable coating speeds. A high temperature may in turn lead to thermal decomposition or premature polymerization of the monomer. If the vapor pressure is too high, condensation and transfer efficiency of the monomer to form a film on the substrate may be too low for a practical and efficient coating operation, unless the surface of the substrate is cooled.

Small amounts of other substances may also be included in the precursor to facilitate deposition and processing. Without limitation, these substances include activators, sensitizers, photoinitiators, and the like. Dyes, pigments, fillers, UV stabilizers, and anti-oxidants are among other materials that also may be included.

The curing used in an embodiment of the present method entails exposure to both beam radiation and ozone, which may be accomplished either simultaneously or sequentially. The beam radiation may comprise charged particles or photons that emanate from suitable sources known in the art and are directed to impinge on the polymer precursor. In various possible embodiments, the beam radiation may be provided by energetic electrons or UV light photons.

For the sake of production efficiency, the present curing process may be carried out in an in-line, continuous process, in which the fibrous substrate material is supplied as a web of indeterminate length that successively advances through stations in which the sheet is first plasma-treated, and thereafter Al metallization and polymer precursor layers are successively deposited, with the sheet finally transiting through an e-beam zone. The application of the polymer precursor layer is optionally preceded by a plasma treatment of the metallization layer, e.g. to induce formation of a native, self-protective oxide film on the Al metallization. The sheet, with its coating partially cured by the e-beam, is subsequently exposed to ozone. In some implementations one or more of the required steps can be accomplished in a separate batch operation. For example, the metalized sheet might be allowed to cool before being again plasma-treated and polymer coated.

In another embodiment, the coated sheet is located in an ozone-containing chamber and advanced as a web while simultaneously being illuminated with beam radiation, thereby providing both exposure modalities simultaneously.

In various other embodiments, the exposure to ozone occurs subsequent to the incidence of beam radiation, and may be done as part of a single continuous process or in a separate operation.

In yet another embodiment, the present sheet is manufactured in a continuous, in-line process that initially produces intermediate rolls bearing an extended, possibly indeterminate length of metalized sheet, with an as-yet incompletely cured polymeric coating. The rolls thereafter are stored in an ozone-containing chamber. After a sufficient storage time, the presence of the ozone will induce curing of some or all of the precursor that was left uncured after the initial exposure to beam radiation. Optionally, the ozone chamber might be maintained at a slightly elevated temperature that further speeds the curing kinetics but is not high enough to damage the substrate polymeric sheet or other constituents.

It is further found that curing of certain precursors amenable to beam-induced free-radical polymerization can also be driven by exposure to an ion or radical ion source, such as the ions present in a suitable plasma discharge. Such a plasma can be created at either atmospheric pressure or in a partial vacuum by suitable choice of the ambient gases. It is believed that the plasma ions or radical ions can generate free radicals that trigger polymerization and cross-linking, but that other mechanisms may also contribute. Representative examples of apparatus used to generate such a plasma discharge include those provided by World Patent Application Publications WO2001/59809, WO2002/28548, and WO2005/110626, and US Published Patent Application US2005/0178330, all of which are incorporated herein in their entirety by reference thereto. Various embodiments of the present method employ plasma exposure as an alternative or supplement to beam radiation.

Thus, in still other embodiments, beam irradiation of the precursor is replaced by exposure to plasma discharge capable of inducing polymerization and cross-linking. In some implementations, the plasma can be formed in a gas of suitable composition nominally at atmospheric pressure. Alternatively, some implementations are carried out in a plasma operating at sub-ambient pressure or in a vacuum; these necessitate a chamber. Embodiments that employ continuous feed implementations further require seals of any convenient type that permit material to pass in and out of the chamber without disrupting its atmosphere.

Figure 5:
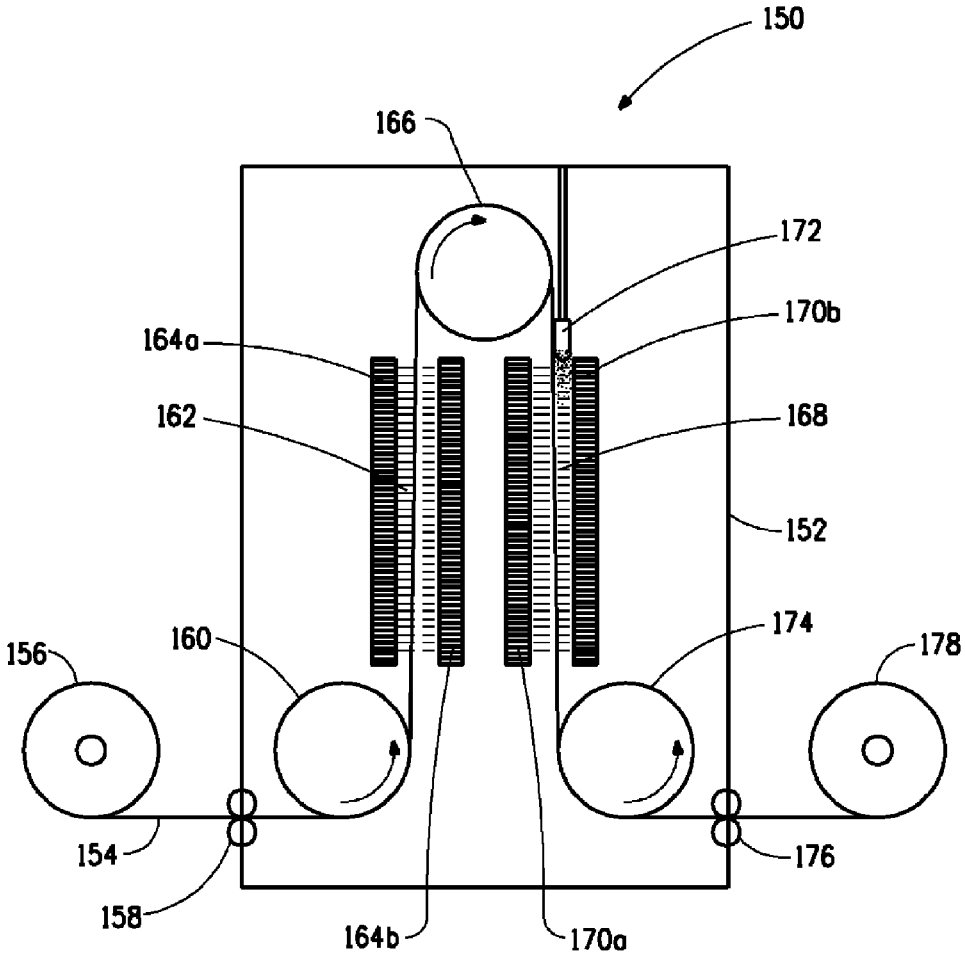
FIG. 5 is a schematic depiction of an apparatus used to deposit a coating on a moving web substrate in the presence of a plasma discharge.

An exemplary apparatus that may be used to deposit precursor and expose it to a plasma discharge that induces curing is depicted schematically by FIG. 5. As shown generally at 150, chamber 152 contains a suitable gas maintained at nominal atmospheric pressure. Web 154 is supplied from feed roll 156 and passes through entry nip roll seal 158 and across first guide roll 160 into first plasma zone 162. The entry and exit nip roll seals 158, 176 permit control of the chamber atmosphere while allowing passage of web 154. Electrodes 164*a*, 164*b* face the respective flat surfaces of web 154 and are energized to create a plasma discharge that cleans and prepares the web surfaces. Web 154 then is passed across second guide roll 166 into second plasma zone 168 defined by energized electrodes 170*a*, 170*b*. The precursor is injected through a nebulizer 172 to create small droplets, which are activated by ions in the plasma, thereby creating a mist of reactive droplets that deposit on the advancing web 154. Typically, polymerization occurs rapidly. Web 154 then passes across third guide roll 174 and through exit nip roll seal 176 for collection on takeup roll 178.

The techniques described herein are useful in the production of composite sheets that may have a variety of layer structures, including the single metalization and coating described above, as well as multiple metalizations and multiple coatings. In composite sheet structures having more than one metal layer, individual metal layers can be formed from the same or different metal and can have the same or different thickness. Similarly, in structures having more than one organic coating layer, the individual organic coating layers can have the same or different composition and/or thickness. Each metal layer can comprise more than one adjacent metal layers wherein the adjacent metal layers can be the same or different. Similarly, each organic layer can comprise more than one adjacent organic layer, wherein the adjacent organic layers can be the same or different. The substrate can be coated on one side, as in the structures described above, or on both sides.

The present process typically minimizes the amount of unconverted precursor in the final product, as measured by the amount of uncured precursor that may be extracted after processing. In various embodiments of the present disclosure, the combination of exposure to beam radiation or plasma discharge and to ozone is sufficient to effect curing of the precursor film to an extent such that the amount of extractable residual uncured precursor may be at most about 20%, or at most about 10%, or at most about 5% by weight of the total precursor deposited. In some embodiments, the present process provides substantially complete polymerization and cross-linking, by which is meant that the amount of extractable, unreacted precursor material is less than 5% by weight of the total precursor deposited.

The permeability of the present sheet structure may conveniently be characterized by its Gurley Hill porosity, which is an art-recognized measure of the barrier of sheet material for gases. In particular, the Gurley-Hill porosity is a measure of how long it takes for a given volume of gas to pass through an area of material wherein a certain pressure gradient exists. Gurley-Hill porosity may be measured in accordance with a protocol promulgated by TAPPI (formerly the Technical Association of the Pulp and Paper Industry) as Official Test Method T-460 om-06, which is incorporated herein by reference. This test measures the time required for 100 cubic centimeters of air to be pushed through a 2.54 cm diameter sample under a differential pressure of approximately 12.45 cm of water. The result is expressed in units of seconds, which are sometimes referred to as Gurley seconds. The Gurley Hill test may be carried out using apparatus such as a Lorentzen & Wettre Model 121D Densometer.

Substrates suitable for forming the composite sheets of the present invention can have a relatively low air permeability, such as between about 5 and about 12,000 Gurley seconds, even between about 20 and about 12,000 Gurley seconds, even between about 100 and about 12,000 Gurley seconds, and even between about 400 and about 12,000 Gurley seconds, which is generally considered to provide a barrier to air infiltration. Alternately, the substrate can be selected to have a relatively high air permeability, for example those sheets having a Gurley Hill air permeability of less than 5 seconds, for which the air permeability may be characterized using the Frazier air permeability test, carried out in accordance with ASTM Standard D737, which is promulgated by ASTM International, West Conshohocken, Pa., and incorporated herein by reference.

In an embodiment, the present composite sheet may have a relatively high moisture vapor permeability, as characterized by a moisture vapor transmission rate measured in accordance with ASTM Standard F1249-06, which is incorporated herein by reference. In an embodiment, a composite sheet with a relatively high air permeability has a moisture vapor permeability of at least about 35 $g/m^2/24$ hours, or even at least about 200 $g/m^2/24$ hours, or even at least about 600 $g/m^2/24$ hours.

It is to be noted that to make a valid and meaningful determination of the effect of the metal and polymer coating on the moisture permeability of the present composite sheet, the uncoated control sheet and the coated sheet being tested should be substantially equivalent. For example, substrate sheet samples from the same roll, lot, etc. used to make the coated sheet can be used to measure the moisture vapor permeability of the starting sheet. In one alternative, a section of the substrate can be masked prior to coating so that the masked section is not coated during the coating process, so that measurements can be made on samples taken from adjacent uncoated and coated portions of the sheet. In another alternative, uncoated samples can be taken from one portion of a roll of the substrate (e.g., its beginning and/or the end) and compared to coated samples made from another portion of the same roll.

The present composite sheet may also have a high hydrostatic head, meaning that the sheet resists penetration of a liquid such as $H_2O$ imposed on it in a static loading. A sheet used as building wrap may thus afford protection against intrusion of rain, snow, or other precipitation. Hydrostatic head is conveniently measured in accordance with standard ISO 811-1981, which is promulgated by the International Organization for Standards, Geneva, Switzerland, and is incorporated herein by reference. Tests of hydrostatic head can be carried out using a Shirley Hydrostatic Head Tester (Shirley Developments Limited, Stockport, England). In various embodiments, the sheet may have a hydrostatic head of at least about 20 cm $H_2O$, even at least about 50 cm $H_2O$, even at least about 100 cm $H_2O$, or even at least about 180 cm $H_2O$.

For use as a building wrap, the composite sheet preferably has a tensile strength of at least about 35 N/cm. Tensile strength can be measured in accordance with ASTM Standard D5035-06, which is incorporated herein by reference.

Substrates suitable for constructing the present composite sheet have a first outer surface and an opposing second outer surface. These substrates include, without limitation, sheets of various forms, such as both woven and nonwoven sheets. In an embodiment, the substrate comprises a woven fabric comprising woven fibers or tapes. In another embodiment, the substrate comprises a nonwoven sheet selected from the group consisting of flash-spun plexifilamentary sheets, spunbond nonwoven sheets, spunbond-meltblown nonwoven sheets, spunbond-meltblown-spunbond nonwoven sheets, and laminates that include a nonwoven or woven sheet or scrim layer bonded to a moisture vapor permeable film layer, such as a microporous film, a microperforated film or a moisture vapor permeable monolithic film. The starting substrate can also comprise a moisture vapor permeable sheet that has been coated using conventional coating methods.

Alternatively, the substrate comprises a multi-layer structure comprising at least one of a nonwoven sheet, a woven sheet, a nonwoven sheet-film laminate, a woven sheet-film laminate, or a composite thereof, with a porous sheet selected from the group consisting of microperforated films, woven sheets, and nonwoven sheets providing the first outer surface.

For example, sheets currently used in the construction industry include sheets of woven tapes that have been coated with a polymeric film layer and microperforated. The substrates may be formed from a variety of polymeric compositions. For example, sheets used in the construction industry are typically formed from polyolefins such as polypropylene or high density polyethylene, polyesters, or polyamides.

According to one embodiment of the invention, the substrate comprises a fibrous, nonwoven or woven sheet. Alternately, the substrate can be a sheet-film laminate wherein the sheet comprises an outer surface of the laminate, or the outer surface of the laminate can be a microperforated film. The metal and organic coating layers are deposited on the sheet or microperforated film such that, in the case of a fibrous sheet, the exposed surfaces of individual fibers or like strands on the coated surface of the composite sheet are substantially covered, while leaving the interstitial spaces or pores between the strands substantially uncovered by the coating material. By "substantially uncovered" is meant that at least 35% of the interstitial spaces between the fibers are free of coating. In one embodiment, the total combined thickness of the organic coating layers is less than the diameter of the fibers of the nonwoven web. For non-fibrous sheets, at least 35% of the surface pores on the sheet surface are substantially uncovered. This provides a coated composite sheet that has a moisture vapor permeability that is at least about 80%, even at least about 85%, and even at least about 90% of the moisture vapor permeability of the starting sheet material.

In an embodiment, the present sheet is fabricated using a moisture vapor-permeable, flash spun, plexifilamentary polyolefin sheet such as TYVEK® flash spun high density polyethylene, available from E. I. du Pont de Nemours and Company, Inc. (Wilmington, Del.), as a substrate sheet. Suitable flash spun plexifilamentary film-fibril materials may also be made from polypropylene or mixtures of polyolefins. The moisture vapor permeable sheet can be a laminate of a flash spun plexifilamentary sheet with one or more additional layers, such as a laminate comprising a flash spun plexifilamentary sheet and a melt-spun spunbond sheet. Flash spinning processes for forming web layers of plexifilamentary film-fibril strand material are disclosed in U.S. Pat. No. 3,081,519 (Blades et al.), U.S. Pat. No. 3,169,899 (Steuber), U.S. Pat. No. 3,227,784 (Blades et al.), and U.S. Pat. No. 3,851,023 (Brethauer et al.), the contents of which are hereby incorporated in their entirety by reference thereto.

The present improved coating and curing process is applicable to a wide variety of products, such as the moisture vapor permeable sheet substrates used in certain commercially available house wrap and roof lining products. Suitable flash-spun plexifilamentary sheets used in building construction include TYVEK® SUPRO roof lining, TYVEK® HomeWrap®, and TYVEK® CommercialWrap®. Other such materials include those sold by E. I. du Pont de Nemours and Company, Inc. (Wilmington, Del.) under trade names that include TYVEK®, Enercor Wall, Enercor Roof, Silver, and Reflex. Generally stated, TYVEK® materials are thin, flash-spun, plexifilamentary sheets comprised of an interlinked network of high density polyethylene fibers.

Other house wrap products suitable as the substrate include Air-Guard® Buildingwrap (manufactured by Fabrene, Inc., North Bay, Ontario), which is a woven fabric of high density polyethylene slit film that is coated with white pigmented polyethylene on one side and perforated; Pinkwrap® Housewrap (manufactured by Owens Corning, Toledo, Ohio), which is a woven fabric of polypropylene slit film that is coated on one side and perforated; Pinkwrap Plus® Housewrap (manufactured by Owens Corning, Toledo, Ohio), which is a cross-ply laminated polyolefin film that is micropunctured and has a corrugated surface; Tuff Wrap® Housewrap (manufactured by Cellotex Corporation, Tampa, Fla.), which is a woven fabric of high density polyethylene film that is coated on one side and perforated; Tuff Weather Wrap® (manufactured by Cellotex Corporation, Tampa, Fla.), which is a polyolefin sheet bonded to a nonwoven scrim that has been embossed to create small dimples on the surface; Greenguard Ultra Amowrap® (manufactured by Amoco, Smyrna, Ga.), which is a woven fabric of polypropylene slit film that is coated on one side and perforated; Weathermate® Plus Housewrap (manufactured by Dow Chemical Company, Midland, Mich.), which is a non-perforated, nonwoven membrane that has been coated with a clear coating; and Typar® Housewrap (manufactured by Reemay, Old Hickory, Tenn.), which is a coated spunbond polypropylene sheet.

The present fabrication and curing process is also applicable for embodiments that provide a metalized substrate that is substantially air impermeable, which is desirable for some end-use applications. For example, the substrate of these embodiments can comprise a laminate of a nonwoven or woven sheet bonded to a moisture vapor permeable film layer, wherein the moisture vapor permeable film layer is a microporous film or a monolithic film. For example, the sheet in some embodiments of such a laminate can be a fabric or scrim. Generally, one or more moisture vapor permeable film layers are sandwiched between outer nonwoven or woven sheet layers and the metal and polymeric coating layers are deposited on at least one of the outer layers such that a polymeric layer forms an outside surface of the composite sheet. In one such embodiment, a moisture vapor permeable film layer is sandwiched between two staple fiber nonwoven layers, or two continuous filament nonwoven layers, or two woven fabrics. The outer fabric or scrim layers can be the same or different.

Moisture vapor permeable, monolithic (nonporous) films useful in the practice of the present invention may be formed from a polymeric material that can be extruded as a thin, continuous, moisture vapor permeable, and substantially liquid impermeable film. The film layer can be extruded directly onto a first nonwoven or woven substrate layer using conventional extrusion coating methods. Preferably, the monolithic film is no greater than about 3 mil (76 μm) thick, even no greater than about 1 mil (25 μm) thick, even no greater than about 0.75 mil (19 μm) thick, and even no greater than about 0.60 mil (15.2 μm) thick. In an extrusion coating process, the extruded layer and substrate layer are generally passed through a nip formed between two rolls (heated or unheated), generally before complete solidification of the film layer, in order to improve the bonding between the layers. A second nonwoven or woven substrate layer can be introduced into the nip on the side of the film opposite the first substrate to form a moisture vapor permeable, substantially air impermeable laminate wherein the monolithic film is sandwiched between the two substrate layers.

Polymeric materials suitable for forming moisture vapor permeable monolithic films include block polyether copolymers such as a block polyether ester copolymers, polyetheramide copolymers, polyurethane copolymers, poly(etherimide)ester copolymers, polyvinyl alcohols, or a combination thereof. Preferred copolyetherester block copolymers are segmented elastomers having soft polyether segments and hard polyester segments, as disclosed in Hagman, U.S. Pat. No. 4,739,012 that is hereby incorporated by reference. Suitable copolyetherester block copolymers include Hytrel®copolyetherester block copolymers sold by E. I. du Pont de Nemours and Company (Wilmington, Del.), and Arnitel® polyetherester copolymers manufactured by DSM Engineering Plastics, (Heerlen, Netherlands). Suitable copolyetheramide polymers are copolyamides available under the name Pebax® from Atochem Inc. of Glen Rock, N.J., USA. Pebax® is a registered trademark of Elf Atochem, S.A. of Paris, France. Suitable polyurethanes are thermoplastic urethanes available under the name Estane® from The B. F. Goodrich Company of Cleveland, Ohio, USA. Suitable copoly(etherimide) esters are described in Hoeschele et al., U.S. Pat. No. 4,868,062. The monolithic film layer can be comprised of multiple layers moisture vapor permeable film layers. Such a film may be co-extruded with layers comprised of one or more of the above-described breathable thermoplastic film materials.

Microporous films are well known in the art, such as those formed from a mixture of a polyolefin (e.g. polyethylene) and fine particulate fillers, which is melt-extruded, cast or blown into a thin film and stretched, either mono- or bi-axially to form irregularly shaped micropores which extend continuously from the top to the bottom surface of the film. U.S. Pat. No. 5,955,175 discloses microporous films, which have nominal pore sizes of about 0.2 micrometer. Microporous films can be laminated between nonwoven or woven layers using methods known in the art such as thermal or adhesive lamination.

In an embodiment, microperforated films are formed by casting or blowing a polymer into a film, followed by mechanically perforating the film, as generally disclosed in European Patent Publication No. EP 1 400 348 A2, which indicates that the microperforations are typically on the order of 0.1 mm to 1.0 mm in diameter.

TYVEK® materials, as well as others listed above, are typically flexible, to permit their use in building and other applications, wherein they may be applied to curved or other non-planar surfaces and are often conformally affixed in large pieces around building corners and at corners associated with fenestrations and other like building openings. The present fabrication and curing process is applicable to flexible substrates, as well as to substantially rigid substrates and others exhibiting lesser flexibility. In an embodiment, flexible forms of the present coated sheet retain the surface metallization and outer polymeric coating without substantial degradation, even after flexure.

In other embodiments, the present composite sheet and coating process may employ a substrate comprising woven or nonwoven polyester, polyimide, polyamide, polysulfone, meta-aramid, or para-aramid fibers, or blends thereof, Alternatively, natural fibers, optionally blended with other of the foregoing fibers, may be used.

In various implementations, the deposition of both the metallization and polymeric coating layers of the present composite sheet may be carried out by any suitable physical vapor deposition technique. Such processes include those carried out in a vacuum, as known in the art. The thicknesses of the metal and polymeric material are preferably controlled within ranges that result in both the desired permeability and thermal properties of the composite.

In alternative implementations, including without limitation those appointed for producing sheets that need not exhibit high vapor permeability, other direct application methods may be used to deposit the polymer precursor, such as methods that employ brushes, pads, rollers, spray coating, dipping, or flow, roll, or curtain coating, or the like. Direct methods beneficially permit the precursor to include components having a wide range of volatility, including high MW components that could not be vaporized readily or low MW components would be difficult to condense on the substrate. Certain substances desirably incorporated in the precursor can be included, such as nonvolatile materials, activators, sensitizers, photoinitiators, UV stabilizers, anti-oxidants, dyes, fillers and pigments. In some embodiments, particularly those in which the precursor contains relatively low MW polymerizable components, sheets can be directly coated while still substantially maintaining a desired high vapor permeability.

In an embodiment, the thickness and the composition of the outer organic coating layer are selected such that the emissivity of the metalized substrate is not significantly increased, while the moisture vapor permeability of the substrate is also substantially unchanged. The outer polymeric coating layer may have a thickness between about 0.1 μm and 5 μm, which corresponds to between about 0.1 $g/m^2$ and 5 $g/m^2$ of the organic coating material, or a thickness between about 0.2 μm and 2.5 μm (about 0.2 $g/m^2$ to 2.5 $g/m^2$), between about 0.2 μm and 1.0 μm (about 0.2 $g/m^2$ to 1.0 $g/m^2$), or between about 0.2 μm and 0.6 μm (about 0.2 $g/m^2$ to 0.6 $g/m^2$). Sheets for which moisture vapor permeability is not required may employ thicker and more robust coatings, e.g. having a thickness between about 10 μm and 100 μm or between about 20 μm and 50 μm.

If the outer polymeric coating layer is too thin, it may not adequately protect the metal layer from degradation (e.g. from hydrolysis or oxidation), resulting in an increase in emissivity of the composite sheet. If the outer organic coating layer is too thick, it may contribute to some reduction of the emissivity of the coated surface and it may be difficult to fully cure the precursor layer, especially using e-beam radiation. In addition, some or all the pores may be bridged, thus reducing the moisture vapor permeability, which may be beneficial for some embodiments of the present composite sheet.

Metals suitable for forming the metalization of the present composite sheets include aluminum, gold, silver, zinc, tin, lead, nickel, titanium, copper, and mixtures and alloys thereof. In an embodiment, the metal layer consists essentially of one of aluminum, gold, silver, zinc, tin, lead, nickel, titanium, copper, or a mixture or an alloy thereof. The metal layer can include other metals or elements, either as impurities or additions, so long as the metallization results in a low emissivity composite sheet. For example, the metal layer may include a thin surface oxide layer, either natively formed or induced. In various embodiments, the oxide layer may passivate the surface and/or improve the adhesion of the polymeric coating. Aluminum is beneficially employed, as it is easy to deposit by evaporation and readily forms a thin oxide passivation layer that affords some degree of surface protection. The metal layer can have any thickness consistent with the properties required for end use. In an embodiment, the metal layer has a thickness between about 15 nm and 200 nm, or between about 30 nm and 60 nm. The metal layer may consist essentially of aluminum having a thickness between about 15 and 150 nm, or between about 30 and 60 nm. If the metal layer is too thin, the layer will be at least partially transparent to visible and infrared wavelengths, so that desired properties, including thermal barrier properties, will not be achieved. If the metal layer is too thick, it can crack and flake off. Generally it is preferred to use the lowest metal thickness that will provide the desired thermal barrier properties. When the composite sheet of the present invention is used as a house wrap or roof lining, the metal layer reflects incident infrared radiation and emits little infrared radiation, providing a thermal barrier that reduces absorption of solar energy during the summer and energy loss by radiation in the winter, thereby reducing the requirements for air conditioning in the summer and heating in the winter, as needed to maintain a comfortable inside temperature year round. Methods for forming the metal layer are known in the art and include without limitation physical vapor deposition methods such as resistive evaporation, electron beam metal vapor deposition, laser ablation, and sputtering.

The thermal barrier properties of a material (i.e., its heat absorbance and reflectance characteristics) can be specified quantitatively by its emissivity, which is conveniently measured in accordance with ASTM Standard C1371-04a, which is incorporated herein by reference. Emissivity tests can be carried out using a Model AE D&S Emissometer (Devices and Services Co., Dallas, Tex.).

It is known that measured emissivity values can be influenced by multiple factors, notably including surface chemistry and roughness. Freshly polished aluminum typically has an emissivity between 0.039 and 0.057, whereas oxidized aluminum can exhibit between about 0.20 and 0.31. Typically, silver has an emissivity between 0.020 and 0.032, and gold between 0.018 and 0.035. In preferred embodiments, the macro-roughness of the present sheet is not significantly altered by the metallization and polymeric coating layers.

In some implementations of the present process, the metal layer and adjacent outer polymeric coating layer are deposited sequentially under vacuum, without free exposure to air or oxygen, to limit oxidation of the metal layer. Minimizing the degree of oxidation of the aluminum by depositing the outer polymeric coating layer prior to exposing the aluminum layer to the atmosphere significantly counters the tendency for the emissivity of the composite sheet to increase over time, compared to sheet having an unprotected layer of aluminum. Long-term protection of the metalized layer is enhanced by substantially complete curing of the outer organic coating layer. This layer also protects the metal from mechanical abrasion during roll handling, transportation and end-use installation.

The present process may be employed with a variety of fibrous substrates, including several conventional forms of TYVEK® sheet. In various embodiments, a fabric-like form of TYVEK® sheet metalized and coated using the present process may have an emissivity no greater about 0.2, or 0.15, or 0.12, or 0.10. In some embodiments, emissivity may be as low as 0.05. A paper-like form with greater microscopic surface roughness may have an emissivity of 0.2-0.25 after metallization and coating. By way of contrast, various conventional forms of TYVEK® sheets without metallization exhibit emissivities that may be as large as 0.5 or more.

The present composite sheets are useful in various building structural aspects, but especially in roof and wall systems. The highly reflective metalized surface of the present composite sheet provides a low emissivity surface that enhances the performance of the insulation and improves the energy efficiency of wall and roof systems, thus reducing energy costs for the building owner. Additional benefits include minimization of condensation inside wall and roof structures in cold climates and shielding of the building from excessive heat during the summer months. In one embodiment of the present invention, the moisture vapor permeable composite sheet is used in a wall or roof system and has an emissivity of no greater than about 0.15, a moisture vapor permeability of at least about 600 g/m$^2$/24 hr, and a hydrostatic head of at least about 100 cm. The composite sheet is preferably installed in a wall or roof system such that the metalized side is adjacent to an air space. Alternately, the side opposite the metalized side can be adjacent an air space. The distance between the composite sheet and the second surface that forms the air space therebetween is preferably at least about 0.75 inch (1.9 cm). It is believed that installing the composite sheet adjacent an air space maximizes its effectiveness as a thermal barrier by allowing it to emit little radiant energy while reflecting most of the radiant energy it sees. If the metalized side is in intimate contact over large areas with solid components of the building construction, the energy may be transferred through the building components by conduction, and the effectiveness of the metalized sheet will be reduced. In pitched roof constructions, installing the composite sheet such that the metalized side faces generally downward and towards the attic space also minimizes the accumulation of dust, dirt, etc. that would tend to reduce its effectiveness as a thermal barrier.

Figure 3:
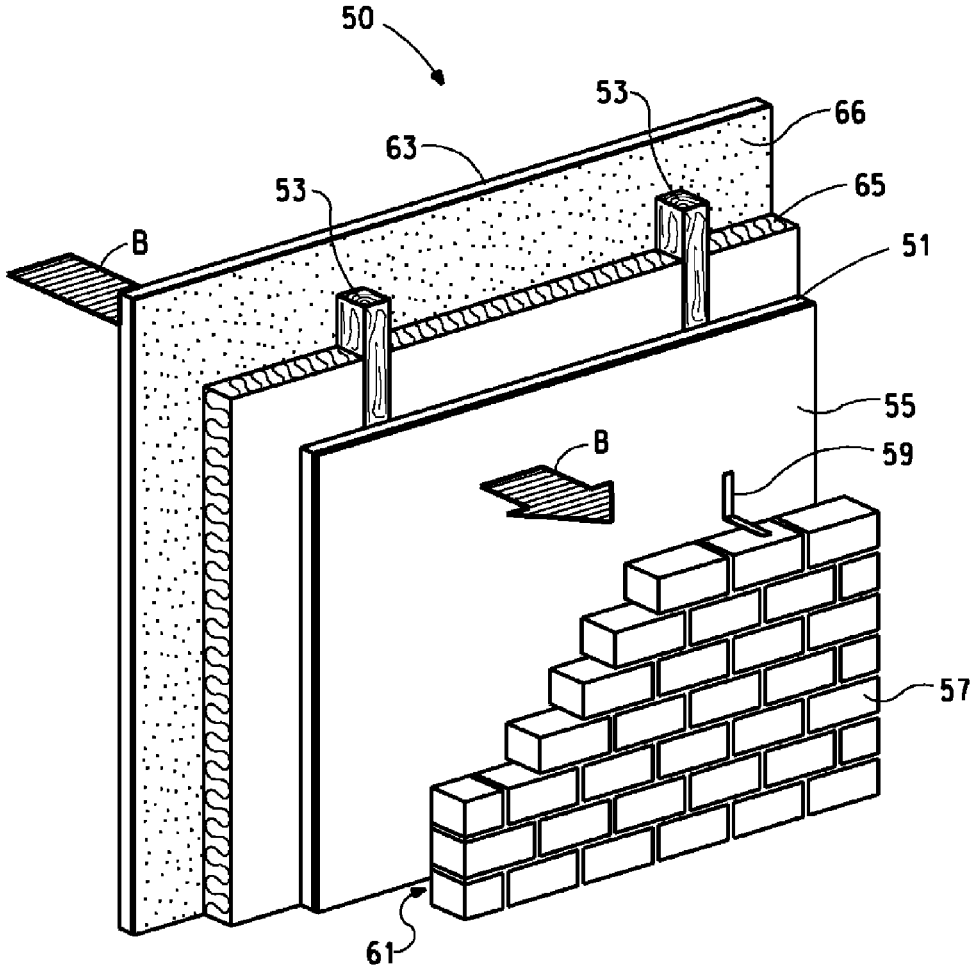
FIG. 3 is a schematic diagram in perspective view of a wall system in which a composite sheet of the present invention is used as a house wrap.

FIG. 3 is a schematic diagram of a wall system 50 in a frame construction building that utilizes the present composite sheet as a house wrap. Sheathing layer 51, such as plywood or the like, is attached to the outside of frame elements 53 that form the load-bearing frame of the building. Vertical frame elements 53 are typically formed of wood (e.g. wooden studs) but can be formed of metal in certain constructions. Breathable composite sheet 55 according to the present disclosure is attached to the outer surface of sheathing 51. In some building constructions, sheathing 51 is not used and the composite sheet 55 is attached directly to frame elements 53. Outer skin 57, which forms the exterior of the building (e.g. brick, concrete block, fiber-reinforced cement, stone, etc.) is separated from the composite sheet by metal straps 59 to form air space 61 therebetween. Wood strips or other spacing members can replace metal straps 59. The composite sheet is preferably installed such that the metalized surface of the composite sheet faces the air space. Alternately, the composite sheet can be installed with the metalized side facing away from the air space. Internal lining 63 (e.g. gypsum wallboard) forms the interior wall of the building. Insulation 65 is installed in the wall between adjacent frame elements and between the internal lining and the sheathing layers (or between the internal lining and the composite sheet if a sheathing layer is not used). The wall structure optionally includes air leakage barrier and vapor barrier layer 66 intermediate the internal lining and insulation material. Layer 66 protects against convective heat loss and prevents excessive moisture generated in the house from penetrating into the insulation. The high moisture vapor permeability of the composite sheet allows water vapor to pass through the composite sheet in the direction of arrow "B" where it is dispersed in air space 61, thus preventing moisture condensation in the insulation. Composite sheets having low air permeability and high hydrostatic head also protect against wind and water penetration.

Figure 4A:
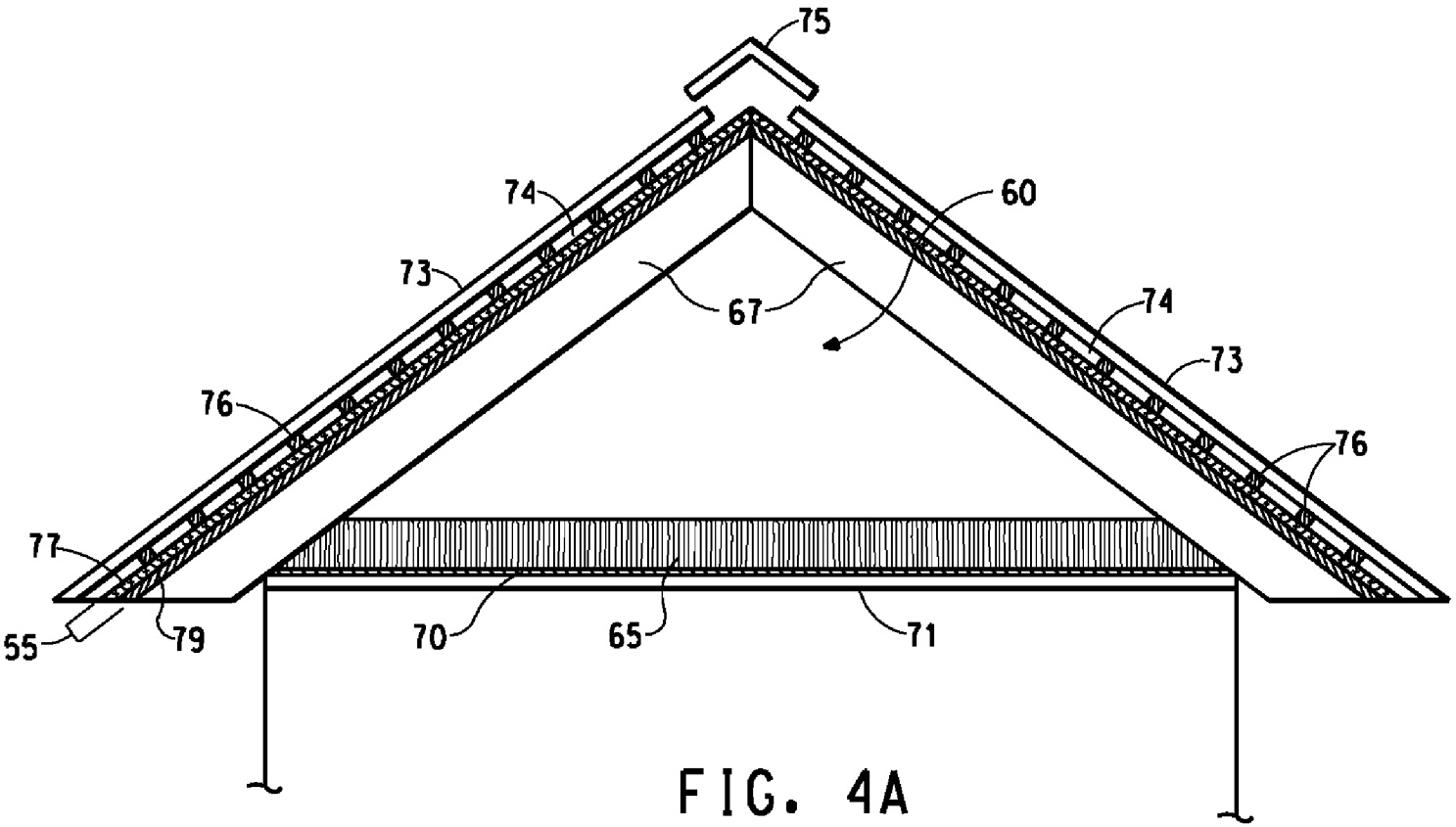
FIGS. 4A-4C are schematic diagrams in cross-sectional view of roof systems in frame construction buildings that include a composite sheet of the present invention and FIG. 4D is a schematic diagram in cross-sectional view depicting installation of a composite sheet on the floor joists of an attic of a building.

FIGS. 4A-4D are schematic diagrams of roof systems in frame construction buildings that include a composite sheet of the present disclosure. FIG. 4A illustrates an example of a "cold roof" system in which the interior attic space 60 is not intended to be habitable. The composite sheet 55 is installed above pitched roof frame elements (e.g. wooden rafters) 67. Insulation material 65 is installed between attic floor joists (not shown) above and adjacent to the level of interior ceiling 71. Optional vapor barrier 70 can be installed intermediate insulation 65 and interior ceiling 71. Spacing members (battens) 76 are placed adjacent the top surface of the composite sheet and external roofing material 73 (e.g. tiles, etc.) is installed on the spacing elements. There is a batten air space 74 above the composite sheet and between spacing elements (battens) 76 and the external roofing material. The ridge of the roof system is designated by 75. Composite sheet 55 is moisture vapor permeable and includes substrate 77 coated with metal and organic coating layers depicted as layer 79. Composite sheet 55 is installed such that the metalized side faces the attic space.

Figure 4B:
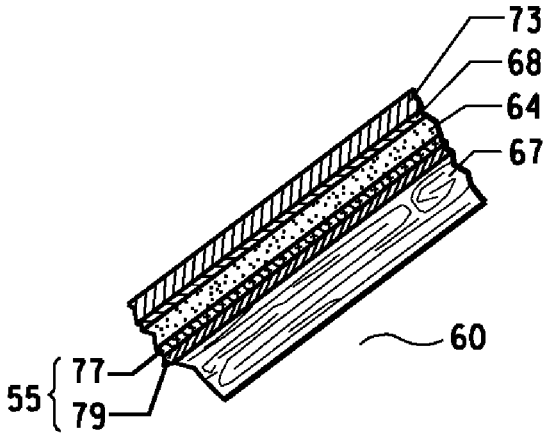
Figure 4C:
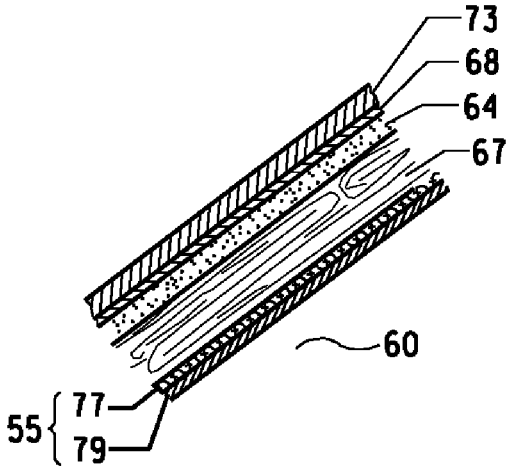

FIG. 4B is a cross-section through a portion of a cold roof system that includes a fully boarded deck instead of a batten system. Composite sheet 55 is installed on top of roof rafters 67, preferably with the metalized side 79 facing down towards the interior attic space 60. A solid roof deck 64 (e.g. plywood) is installed over the composite sheet and the external roofing is installed over the solid decking. Examples of external roofing include asphalt-coated felt or other roofing underlayment material 68 with exterior roofing material 73 such as tiles or asphalt shingles placed over the roofing underlayment. In another embodiment of a fully boarded deck shown in FIG. 4C, the metalized sheet 55 is attached to the underside of the roof rafters 67, with the metalized side 79 preferably facing down towards attic space 60. The composite sheet can be installed with the metalized side 79 facing away from the attic space; however dust and dirt accumulation on the metalized side can result in an increase in emissivity with time and a reduction in thermal barrier properties.

Figure 4D:
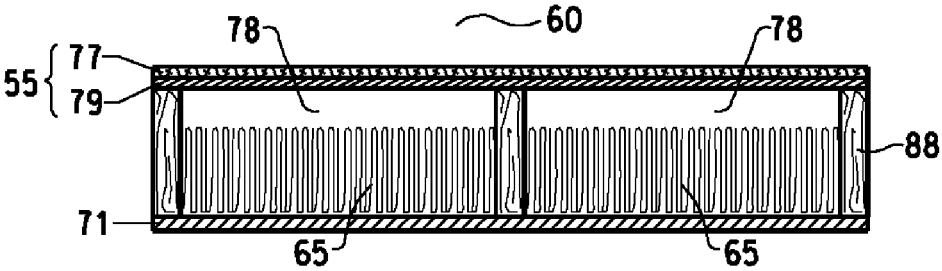

The composite sheet can also be installed on top of the attic floor joists 88 as shown in FIG. 4D. The composite sheet 55 is preferably installed with the metalized side 79 facing down, away from interior attic space 60 and towards insulation material 65, for the reasons stated above. An air space 78 is preferably provided between the insulation and the composite sheet.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

Examples 1-3

The efficacy of ozone ($O_3$) for promoting acrylate conversion was tested using propoxylated neopentyl glycol diacrylate (available commercially under the trade name SR9003 from Sartomer Company, Inc., Exton, Pa.).

For each example, eight samples of the SR9003 precursor having a mass of about 25 mg each and a bulk thickness of about 225 μm were charged into small aluminum pans. Each sample was doped with dimethyl suberate (5% by weight). These pans were transferred to a sealed quartz enclosure, which was maintained at room temperature with a low through flow (0.2 ml/min) of dry laboratory air.

Then the dry air flow entering the quartz enclosure was charged with ozone from an ozone generator (CD10 Corona Discharge System manufactured by ClearWater Tech, San Luis Obispo, Calif.). The generator was operated at three different preselected input power levels, i.e. at 100% of its rated capacity (Example 1), at 50% (Example 2), and at 10% (Example 3), to provide different levels of ambient ozone. At different points during the exposure of each sample, the generator was shut off for 5 minutes to permit the ozone to dissipate, with the dry air flow being maintained. After each interruption, a sample was removed, quenched with chloroform (1 g) for extraction, and sonicated for 2 hours. Analysis of those samples by gas chromatography permitted measurement of the amount of monomer that remained unconverted. Conversion fraction was determined for each sample in the three examples using these data, producing the results set forth in Table I below. The efficacy of the extraction technique was confirmed by analysis that showed the dimethyl suberate standard was fully extracted.

TABLE I

| Conversion of Monomer after Ozone Exposure | | | |
|---|---|---|---|
| Exposure | Fraction Converted | | |
| Time (h) | Example 1 (100% power ) | Example 2 (50% power) | Example 3 (10% power) |
| 0 | 0 | 0 | 0 |
| 1 | 0.25 | 0.32 | 0.23 |

TABLE I-continued

| Conversion of Monomer after Ozone Exposure | | | |
|---|---|---|---|
| Exposure | Fraction Converted | | |
| Time (h) | Example 1 (100% power ) | Example 2 (50% power) | Example 3 (10% power) |
| 2 | 0.49 | 0.70 | 0.25 |
| 3 | 0.68 | 0.81 | 0.39 |
| 4 | 0.77 | 0.96 | 0.52 |
| 5 | 0.85 | 0.90 | — |
| 6 | 0.90 | 0.92 | |
| 8 | — | — | 0.75 |
| 12 | — | — | 0.95 |
| 18 | 0.91 | — | — |

The data of Table I establish the efficacy of ozone for initiating conversion of an acrylate monomer useful as a coating material at each of the ambient ozone levels tested. Even at the lowest ozone level (Example 3), substantially complete conversion was obtained within an acceptable time, albeit at a rate less than that seen with the higher ozone levels provided in Examples 1 and 2.

Example 4

The efficacy of ozone ($O_3$) for promoting conversion of an acrylate coated onto a TYVEK® 1560B plexifilamentary sheet prepared with a 65 nm thick aluminum metallization layer was tested.

SR9003 precursor (propoxylated neopentyl glycol diacrylate as a 13% solution by weight in diethyl ether) was manually coated on 5 cm-square samples of the metallized, plexifilamentary sheet substrate. A suitable small amount of the acrylate was put on a surface of the substrate and dispersed uniformly using a metal coating rod. The rod had a diameter of about 1 cm and its surface was covered with a helical, closely spaced wrapping of 0.3 mm diameter wire. After the ether evaporated, the samples had a 1.0 g/m$^2$ acrylate coating, corresponding to a thickness of approximately 1 μm.

The samples were then exposed to ozone using a protocol similar to that employed for Examples 1-3. The samples were placed in to the same room-temperature, sealed quartz enclosure, with a low flow (0.2 ml/min) of dry air again maintained.

Ozone treatment was provided using the CD10 ozone generator operated at its maximum input power level (100%) to charge the dry air flow entering the enclosure. At selected intervals, after shutting off the generator for 5 minutes to allow ozone to dissipate, one of the samples was removed, quenched with chloroform (1 g) for extraction, and sonicated for 2 hours. Analysis of those various samples by gas chromatography was used to measure the amount of monomer that remained unconverted. Conversion fraction was determined for each sample using these data, producing the results for Example 5 that are set forth in Table II below. The data point indicated as 54 h was obtained on a sample that was exposed to ozone for 6 h, then removed and allowed to sit in room air for an additional 48 h.

TABLE II

| Conversion of Coated Monomer after Ozone Exposure | |
|---|---|
| Exposure Time (h) | Example 4 Fraction Converted |
| 0 | 0 |
| 2 | 0.46 |

TABLE II-continued

| Conversion of Coated Monomer after Ozone Exposure | |
|---|---|
| Exposure Time (h) | Example 4 Fraction Converted |
| 4 | 0.71 |
| 54* | 0.91 |

*Exposed to ozone for 6 h then to air for 48 h.

The data in Table II demonstrate that ozone exposure promotes curing of an acrylate precursor coating on a plexifiliamentary sheet.

Example 5

The experiment of Example 4 was repeated with fresh substrate material, producing the data set forth in Table III below.

TABLE III

| Conversion of Coated Monomer after Ozone Exposure | |
|---|---|
| Exposure Time (h) | Example 5 Fraction Converted |
| 0 | 0.00 |
| 1 | 0.29 |
| 2 | 0.29 |
| 4 | 0.53 |
| 6 | 0.89 |
| 8 | 0.84 |

Together, the data of Examples 4 and 5 (Tables II and Ill) show that the kinetics of conversion of an acrylic monomer coating on TYVEK sheet samples are comparable to the kinetics of conversion of the monomer itself, as provided in the data of Examples 1-3 above. Exposure to ozone at room temperature is thus established as efficacious for initiating conversion of an acrylate monomer coated on a metalized fibrous substrate material.

Example 6

The efficacy of ozone ($O_3$) for improving the conversion of an acrylate coating on a fibrous sheet was tested using samples taken from a web of TYVEK® 1560B plexifilamentary sheet prepared with a 65 nm thick aluminum metallization layer. After metallization, the web was coated using an evaporation process to deposit a layer of SR9003 (propoxylated neopentyl glycol diacrylate) with a coating density of about 0.8 g/m$^2$. The layer was then exposed to e-beam radiation to form a partially cured polyacrylate. The residual content of unconverted monomer of a sample of this sheet ("Control 1") was determined by the same gas chromatography protocol described above in Examples 1-3, yielding a value corresponding to about 0.15 g/m$^2$, or about 19% of the deposited precursor, as shown in Table IV below. It was thus inferred that about 81% of the deposited precursor had been converted by the initial e-beam treatment.

A second control value ("Control 2") was determined in the same way for an e-beam irradiated sheet that was stored in air for 16 h. Its content of unconverted acrylate was about 0.14 g/m$^2$, showing only a modest decrease in the amount of residual precursor, which may be attributed to evaporation.

Additional samples of the e-beam irradiated sheet were then exposed to ozone using the same chamber and ozone source as employed for the experiments of Examples 1-3 above. Samples were given ozone exposures of 0.5 h, 2 h, 4 h, and 16 h. These data in Table IV show that exposure to ozone promotes further curing of a sample in which partial conversion was initiated by a previous exposure to e-beam radiation, and that the ozone exposure promotes further elimination of extractable precursor at a rate higher than what would be obtained solely from evaporation and aging.

TABLE IV

| Conversion of Coated Monomer after Ozone Exposure | | |
|---|---|---|
| Exposure | Example 6 | |
| Time (h) | Extractable Acrylate (g/m$^2$) | Fraction Converted |
| Control 1 | 0.15 | 0.81 |
| Control 2 | 0.14 | 0.82 |
| 0.5 | 0.14 | 0.83 |
| 2 | 0.11 | 0.86 |
| 4 | 0.10 | 0.88 |
| 16 | 0 | 1.00 |

Having thus described the invention in rather full detail, it will be understood that this detail need not be strictly adhered to but that further changes and modifications may suggest themselves to one skilled in the art, all falling within the scope of the invention as defined by the subjoined claims

Where a range of numerical values is recited or established herein, the range includes the endpoints thereof and all the individual integers and fractions within the range, and also includes each of the narrower ranges therein formed by all the various possible combinations of those endpoints and internal integers and fractions to form subgroups of the larger group of values within the stated range to the same extent as if each of those narrower ranges was explicitly recited. Where a range of numerical values is stated herein as being greater than a stated value, the range is nevertheless finite and is bounded on its upper end by a value that is operable within the context of the invention as described herein. Where a range of numerical values is stated herein as being less than a stated value, the range is nevertheless bounded on its lower end by a non-zero value.

In this specification, unless explicitly stated otherwise or indicated to the contrary by the context of usage, where an embodiment of the subject matter hereof is stated or described as comprising, including, containing, having, being composed of, or being constituted by or of certain features or elements, one or more features or elements in addition to those explicitly stated or described may be present in the embodiment. An alternative embodiment of the subject matter hereof, however, may be stated or described as consisting essentially of certain features or elements, in which embodiment features or elements that would materially alter the principle of operation or the distinguishing characteristics of the embodiment are not present therein. A further alternative embodiment of the subject matter hereof may be stated or described as consisting of certain features or elements, in which embodiment, or in insubstantial variations thereof, only the features or elements specifically stated or described are present. Additionally, the term "comprising" is intended to include examples encompassed by the terms "consisting essentially of" and "consisting of." Similarly, the term "consisting essentially of" is intended to include examples encompassed by the term "consisting of."

When an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

In this specification, unless explicitly stated otherwise or indicated to the contrary by the context of usage, (a) amounts, sizes, ranges, formulations, parameters, and other quantities and characteristics recited herein, particularly when modified by the term "about", may but need not be exact, and may also be approximate and/or larger or smaller (as desired) than stated, reflecting tolerances, conversion factors, rounding off, measurement error, and the like, as well as the inclusion within a stated value of those values outside it that have, within the context of this invention, functional and/or operable equivalence to the stated value; and (b) all numerical quantities of parts, percentage, or ratio are given as parts, percentage, or ratio by weight; the stated parts, percentage, or ratio by weight may or may not add up to 100.

What is claimed is:

1. A process for manufacturing a composite sheet comprising:

providing a substrate having a first outer surface and an opposing second outer surface, the substrate comprising a nonwoven sheet selected from the group consisting of flash-spun plexifilamentary sheets, spunbond nonwoven sheets, spunbond-meltblown nonwoven sheets, spunbond-meltblown-spunbond nonwoven sheets, and laminates that include a nonwoven sheet or scrim bonded to a moisture vapor permeable film layer;

metalizing the first outer surface of the substrate to form thereon a metal layer;

depositing on the metal layer a precursor of an outer polymeric coating layer to form a precursor film, the precursor comprising a composition capable of being converted by free-radical processes; and treating the precursor to form the outer polymeric coating layer, the treating comprising:

creating free radicals in the precursor to induce conversion of at least a portion thereof, the creating comprising exposure of the precursor film to ozone and irradiating the first outer surface with beam radiation provided by a radiation source.

2. The process of claim 1, wherein the creating of free radicals comprises irradiating the first outer surface with beam radiation provided by a radiation source.

3. The process of claim 2, wherein the beam radiation comprises electron beam radiation.

4. The process of claim 2, wherein the beam radiation comprises UV radiation.

5. The process of claim 1, wherein the creation of free radicals is sufficient to effect conversion of the precursor such that the amount of uncured precursor extractable from the composite sheet is at most about 10% by weight of the outer polymeric coating layer.

6. The process of claim 5, wherein the creation of free radicals is sufficient to effect substantially full conversion of the precursor film.

7. The process of claim 1, wherein the depositing comprises providing the precursor as a precursor vapor and condensing the precursor vapor onto the metal layer to form the precursor film.

8. The process of claim 1, wherein the precursor comprises an acrylate or methacrylate composition.

9. The process of claim 1, wherein the metalizing is accomplished by a physical vapor deposition technique.

10. The process of claim 1, wherein the metal layer consists essentially of Al.

11. The process of claim 2, wherein the irradiation with beam radiation is carried out in a vacuum.

12. The process of claim 2, wherein the irradiation with beam radiation is carried out prior to the exposure to ozone.

13. The process of claim 1, wherein the outer polymeric coating layer has a thickness ranging from about 0.1 to 5 μm.

14. The process of claim 1, wherein the substrate is moisture vapor permeable.

15. The process of claim 1, wherein the moisture vapor transmission rate of the composite sheet after conversion is at least about 80% of the moisture vapor transmission rate of the substrate without the metal and outer polymeric coating layers.

* * * * *